US011776386B2

(12) United States Patent
Bouchard et al.

(10) Patent No.: US 11,776,386 B2
(45) Date of Patent: Oct. 3, 2023

(54) SMOKE SENSOR WITH TEST SWITCH AND METHOD OF OPERATION THEREOF

(71) Applicant: Tyco Fire & Security GmbH, Neuhausen am Rheinfall (CH)

(72) Inventors: Kim Bouchard, Saint-Laurent (CA); Meagen Wyganowski, Chateauguay (CA)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 257 days.

(21) Appl. No.: 16/004,766

(22) Filed: Jun. 11, 2018

(65) Prior Publication Data

US 2019/0378402 A1 Dec. 12, 2019

(51) Int. Cl.
*G08B 7/06* (2006.01)
*G08B 29/14* (2006.01)

(52) U.S. Cl.
CPC ..... *G08B 29/145* (2013.01); *G08B 7/06* (2013.01)

(58) Field of Classification Search
CPC .... G01D 5/2515; G08B 29/14; G08B 29/145; G08B 21/12; G01N 33/0065; G01N 33/004
See application file for complete search history.

(56) References Cited

U.S. PATENT DOCUMENTS 6,624,750 B1 * 9/2003 Marman ..... G08B 25/003 340/4.3
8,794,389 B2 * 8/2014 Marien ..... B66B 5/0093 187/391
9,767,679 B2 * 9/2017 Piccolo, III ..... G08B 29/145
2002/0021224 A1 * 2/2002 Schneider ..... G08B 29/145 340/628
2008/0101789 A1 * 5/2008 Sharma ..... G08B 13/1963 396/427
2009/0128353 A1 * 5/2009 Gonzales ..... G08B 25/04 340/691.5
2015/0248832 A1 * 9/2015 Piccolo, III ..... G08B 29/145 340/514

* cited by examiner

*Primary Examiner* — Hai Phan
*Assistant Examiner* — Anthony D Afrifa-Kyei
(74) *Attorney, Agent, or Firm* — ArentFox Schiff LLP

(57) ABSTRACT

A smoke sensor with test switch and a method of operation thereof are disclosed. The smoke sensor is an example of a fire alarm initiation device that is deployed in a building, and is part of a fire alarm system at the building. Fire alarm initiation devices include a fire detection system for detecting an indication of fire, a normally deactivated test switch that is activated during testing of the device, and a controller. The controller senses the activation of the test switch, and in response, prevents the device from sending an alarm message upon the fire detection system detecting the indication of fire. In one example, the test switch is a magnetic reed switch that is activated when a hood of a test tool is placed over the device, the hood including a magnet that comes within proximity of the magnetic reed switch to activate the switch.

25 Claims, 8 Drawing Sheets

SMOKE SENSOR WITH TEST SWITCH AND METHOD OF OPERATION THEREOF

BACKGROUND OF THE INVENTION

Fire alarm systems are often installed within buildings such as commercial, residential, or governmental buildings. Examples include hospitals, warehouses, schools, malls and casinos, to list a few examples. These fire alarm systems typically include a control panel and fire alarm initiating devices and fire alarm notification devices, which are installed throughout the buildings. Some examples of fire alarm initiating devices include smoke sensors, carbon monoxide detectors, heat sensors, and pull stations. Some examples of fire alarm notification devices include speakers/horns, bells/chimes, light emitting diode (LED) reader boards, and/or flashing lights (e.g., strobes).

The fire alarm initiation devices monitor the buildings for indications of fire. Indications of fire include flame, heat, and smoke, in examples. Upon detection of an indication of fire, the device is activated and an alarm message is sent from the activated device to the fire control panel. Typically, the fire control panel generates an alarm condition in response to receiving the alarm messages. The alarm condition activates audio and visible alarms of the fire alarm notification devices of the fire alarm system and sends a message to a fire department, central receiving station, local monitoring station, and/or other building alarm/notification systems.

Typically, the fire alarm initiation and fire alarm notification devices are periodically tested (e.g., monthly, quarterly, or annually) depending on local interpretation and enforcement of fire protection codes) to verify that the fire detection and fire alarm notification devices are physically sound, unaltered, working properly, and located in their assigned locations. This testing of the fire alarm initiation and fire alarm notification devices is often accomplished with a walkthrough test.

Historically, walkthrough tests were performed by a team of at least two inspectors as part of a two person walkthrough system. In this system, the fire alarm initiation and fire alarm notification devices targeted for testing were organized into zones. During testing, the control panel was placed into a test mode that selected one zone at a time for testing. The control panel sent control messages to disable all devices in the tested zone, and disabled its ability to generate an alarm condition in response to receiving alarm messages from devices in the tested zone.

In more detail, the first inspector walked through the building and manually activated each fire alarm initiation device and fire alarm notification device in the tested zone while the second inspector remained at the control panel to verify that the control panel received an alarm message from the activated device. The inspectors would typically communicate via two-way radios or mobile phones to coordinate the testing of each device. In some cases, the inspectors might even have resorted to comparing hand written notes of the tested devices.

After a zone of devices were tested, the inspector at the panel reset the control panel while the other inspector moved to the next zone of fire alarm initiation or fire alarm notification devices. The control panel was then placed into test mode for the next zone of devices.

The two-person walkthrough system had many limitations. The system required two inspectors and additional components beyond the control panel and target devices, such as two-way radios and/or mobile phones. The system also required significant coordination among the inspectors.

For example, the inspector at the control panel could place the control panel into a test mode for the wrong zone, resulting in false alarms. Moreover, because all devices in each tested zone were disabled, the devices would not detect an actual fire in the tested zone. As a result, a "fire watch" was required, where the second inspector (and possibly other individuals) had to manually watch for indications of fire within the tested zone.

Recently, single person walkthrough systems have been proposed. In the single person walkthrough systems, an inspector places the control panel in a test mode, and then uses a testing apparatus ("test tool") to initiate testing of individual fire alarm initiation or fire alarm notification devices. In response, the individual device sends test mode messages to the control panel, to indicate that the device should be placed into a test mode by the control panel.

When the devices in test mode detect an indication of fire during testing, the devices send alarm messages to the control panel, but the control panel does not initiate an alarm condition. This is because the alarm messages are not associated with actual fires in the building, which eliminates false alarms. If, however, the control panel receives alarm messages from any of the other devices in the normal operation mode, then the control panel initiates an alarm condition. The testing process repeats with the next fire alarm initiation or fire alarm notification device until all of the devices of the alarm system have been verified.

SUMMARY OF THE INVENTION

A proposed single-person walkthrough system improves upon existing single person walkthrough systems. The proposed system can eliminate the need to place the control panel in test mode. Instead, the control panel operates in its normal mode. It can also eliminate the request/response handshake between the devices and the control panel to place the devices in "test mode." The devices in test mode might not send alarm messages in response to detecting indications of fire during testing. Rather, the devices send messages that include test results of the tests executed at each of the devices. In this way, not only does the control panel obtain more meaningful information from each device in response to testing, but the control panel can also combine/aggregate the test results from multiple devices into a test report. The test report is then available to the inspectors or other security personnel.

In general, according to one aspect, the invention features a fire alarm initiating device. The fire alarm initiating device includes a fire detection system for detecting an indication of fire, a normally deactivated test switch that is activated during testing of the device, and a controller. The controller senses the activation of the test switch, and in response, prevents the device from sending an alarm message upon the fire detection system detecting the indication of fire.

In an embodiment, the test switch is a magnetic reed switch that is activated when a hood of a test tool is placed over the device. Here, the hood includes a magnet that comes within proximity of the magnetic reed switch to activate the magnetic reed switch. The magnet activates the magnetic reed switch when the magnet is aligned with and opposite to the magnetic reed switch, and the magnetic reed switch is deactivated when the hood is removed from the device.

The device also includes an indicator. The indicator is energized to provide visual or audible indications during the testing of the device. Moreover, the hood is made from a transparent material that enables the indicator to be seen during the testing of the device.

Preferably, the controller executes a testing sequence for testing of the device, and sends messages that include test results of the testing sequence to a control panel. In one example, the device includes a memory, and the testing sequence is located in the memory.

In general, according to another aspect, the invention features a method for a fire alarm initiating device. The method includes a fire detection system detecting an indication of fire, and activating a normally deactivated test switch of the device during testing of the device. The activating of the test switch prevents the device from sending an alarm message in response to the fire detection system detecting the indication of fire.

Preferably, the test switch is activated by placing a hood of a test tool over the device, the hood including a magnet that activates a magnetic reed switch as the test switch. The method also includes deactivating the magnetic reed switch by removing the hood from being placed over the device.

The method additionally includes the test tool delivering smoke, heat, or carbon monoxide (CO) to the device via the hood during testing of the device. Typically, only one of the smoke, heat, or CO can be tested at a time.

In general, according to yet another aspect, the invention features a fire testing system. The fire testing system includes at least one fire alarm initiating device and a test tool. The fire alarm initiating device includes a normally deactivated test switch that is activated during testing of the device, a fire detection system detecting an indication of fire, and a controller. The controller senses the activation of the test switch, and in response, prevents the device from sending an alarm message upon the fire detection system detecting the indication of fire. The test tool includes a hood that is placed over the device, and the hood includes a test switch activation mechanism within the hood that activates the test switch of the device when the hood is placed over the device.

The test switch activation mechanism activates the test switch of the device when the test switch activation mechanism is aligned with and opposite to the test switch. Preferably, the test switch of the device is a magnetic reed switch and the test switch activation mechanism is a magnet. The magnet is typically mounted in a sidewall of the hood. Preferably, the hood is made from a transparent material.

In general, according to still another aspect, the invention features a test tool. The test tool includes a base and a hood attached to the base, a canister, a wand, and a test switch activation mechanism within the hood. The canister is contained within the base and delivers smoke, heat, or carbon monoxide. The wand is attached to the base for holding the base, and the wand includes a wand activation mechanism for controlling the test tool. The test switch activation mechanism activates a test switch of a fire alarm initiating device when the hood is placed over the fire alarm initiating device.

In general, according to still yet another aspect, the invention features a fire alarm system. The fire alarm system includes fire alarm initiating devices that detect indications of fire and a control panel. Each of the devices include a normally deactivated test switch that is activated during testing of the devices. The activation of the test switch prevents sending of alarm messages from the devices in response to the devices detecting the indications of fire during the testing. The control panel receives test results from the devices upon the devices completing testing.

The control panel includes one or more slave cards. The slave cards receive the test results from the devices and create a test report from the test results. The control panel also remains in a normal operation mode during the testing of the devices.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

It will be understood that although terms such as "first" and "second" are used herein to describe various elements, these elements should not be limited by these terms. These terms are only used to distinguish one element from another element. Thus, an element discussed below could be termed a second element, and similarly, a second element may be termed a first element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
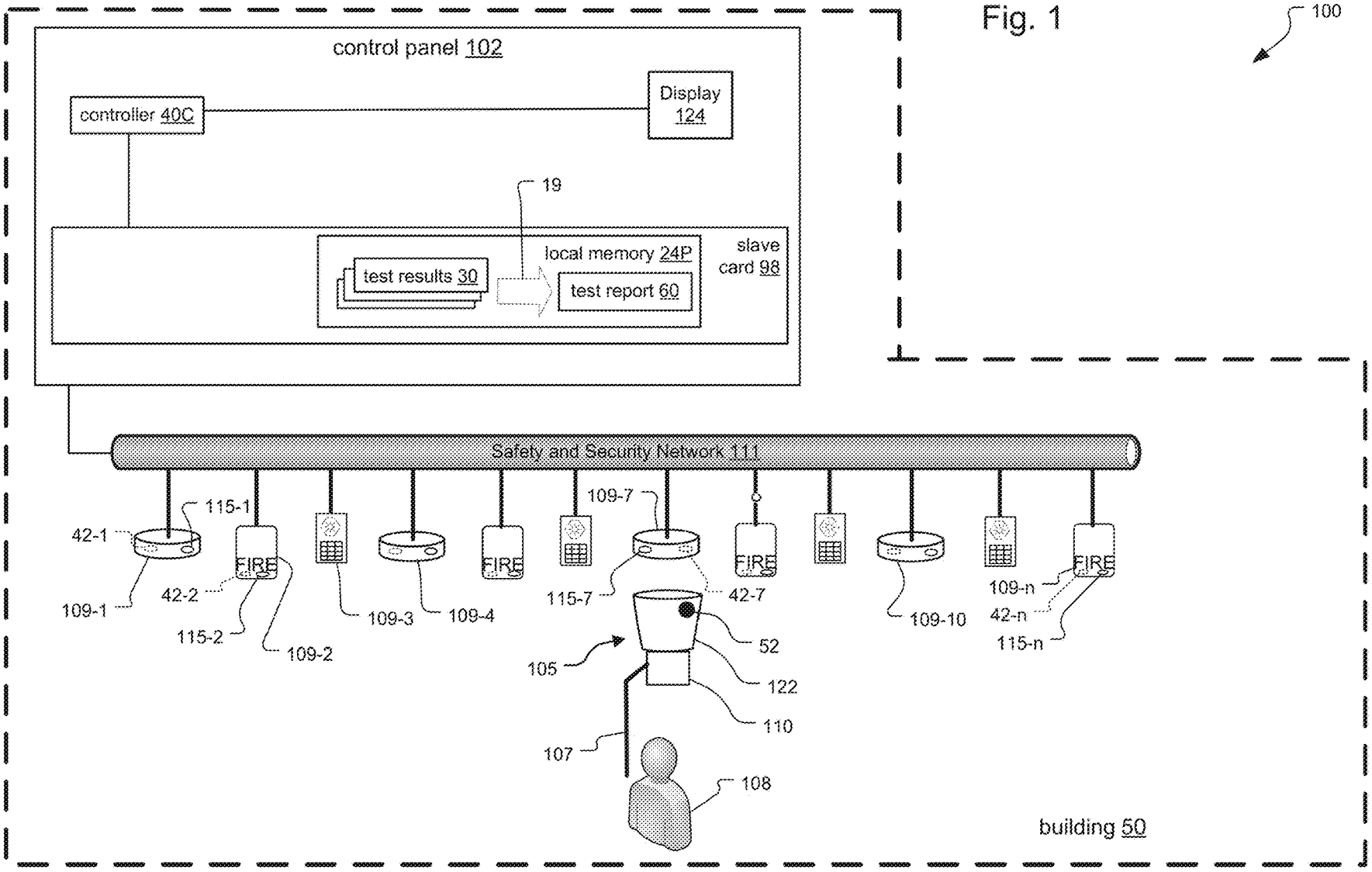
FIG. 1 is a block diagram illustrating a fire alarm system installed at a building, where the system includes fire alarm initiating devices and fire alarm notification devices, and where an inspector carrying a test tool for individual testing of the devices is also shown.

FIG. 1 is a block diagram illustrating a fire alarm system 100 installed at a building 50.

The fire alarm system 100 includes fire alarm initiating devices and fire alarm notification devices 109 and a control panel 102. The devices 109 are mounted to walls or ceilings of the building 50 and communicate with the control panel 102 over a safety and security network 111.

Fire alarm initiating devices such as smoke sensors 109-1/109-7, a heat sensor 109-4, a carbon monoxide detector 109-10, and pull stations 109-2 are shown. Fire alarm notification devices such as strobes 109-3 are also shown. Each of the fire alarm initiating devices and fire alarm notification devices 109-1 through **109-*n* respectively include a test switch 42-1 through 42-*n*, and a light emitting device 115-1 through 115-*n***.

Preferably, each fire alarm initiating device 109 includes a fire detection system for detecting an indication of fire, a normally deactivated test switch 42 that is activated during testing of the device 109, and a controller. The controller senses the activation of the test switch 42, and in response, prevents the device from sending an alarm message upon the fire detection system detecting the indication of fire.

The control panel 102 includes a display 124, a controller 40C and one or more slave cards 98. In one implementation, the control panel 102 has a backplane or equipment rack that accepts and contains the slave cards 98. One such slave card 98 is shown. In another implementation, the slave cards 98 are contained in an equipment rack or housing that is separate from the control panel 102.

The slave cards 98 include local memory 241 and operate as an intermediary between the devices 109 on the network 111 and the control panel 102. The slave cards 98 provide power to the devices 109 over the network 111, insulate the control panel 102 from faults associated with the devices 109, and provide a communications interface between the control panel 102 and the devices 109. In this way, the slave cards 98 operate as an intermediary between the control panel 102 and the devices 109.

Each slave card 98 supports a certain number of devices that form a group that are usually associated with one or more loops and/or zones. When an inspector adds more devices 109 to the fire alarm system 100, additional slave cards 98 are added to provide power to the devices 109 and to enable communications with the control panel 102 and the devices 109. In this way, the control panel 102 can support an increasing number of devices 109 without requiring changes to the control panel 102 itself.

The slave cards 98 monitor the devices 109 for faults. Upon detecting a fault with one or more of the devices 109 in its group/zone, each slave card 98 can isolate/disable problem devices 109 and notify the control panel 102.

Each slave card 98 receives and accumulates messages from its group of devices 109, and determines whether to forward the messages to the control panel 102. The messages include information associated with alarms (i.e. alarm messages), and include test results 30 sent from devices 109 upon completion of testing of the devices 109. When the messages are alarm messages, the slave devices 98 immediately forward the alarm messages to the control panel 102. When the messages include test results 30, the slave cards 98 store the test results 30 to the local memory 24P, and generate a test report 60 that includes the test results 30 from one or more devices 109. The controller 40C also stores the test report 60 to the local memory 24P. Reference 19 indicates that the controller 40C generates the test report 60 from the test results 30 sent from one or more devices 109.

The slave cards 98 also receive information sent from the control panel 102 on behalf of the devices 109. In one example, when the control panel raises an alarm condition, the information includes notification signals that the control panel 102 sends to fire alarm notification devices 109 to notify and warn building occupants. The slave cards 98 then forward this information over the network 111 to its devices 109 and also sends instructions to activate those devices. In another example, the information includes control signals that enable/disable one or more devices 109.

When the controller 40C receives alarm messages forwarded by the slave cards 98, the control panel 102 raises an alarm condition. In response to the alarm condition, the control panel 102 sends notification signals to the slave cards 98, displays the locations of the device(s) that sent the alarm messages on the display 124, and notifies a call center or monitoring service. The monitoring service then dispatches first responders such as a fire brigade to the building 50.

In the illustrated example, an inspector 108 is also shown carrying a test tool 105. The inspector 108 uses the test tool 105 to individually test the fire alarm initiating devices 109. The test tool 105 includes a base 110, a wand 107 attached to the base, and a hood 122 attached to the base 110. A magnet 52 as an example of a test switch activation mechanism is located within the hood 122. The inspector 108 is about to initiate testing of smoke sensor 109-7. For this purpose, the inspector 108 places the hood 122 of the test tool 105 over the smoke sensor 109-7.

Figure 2A:
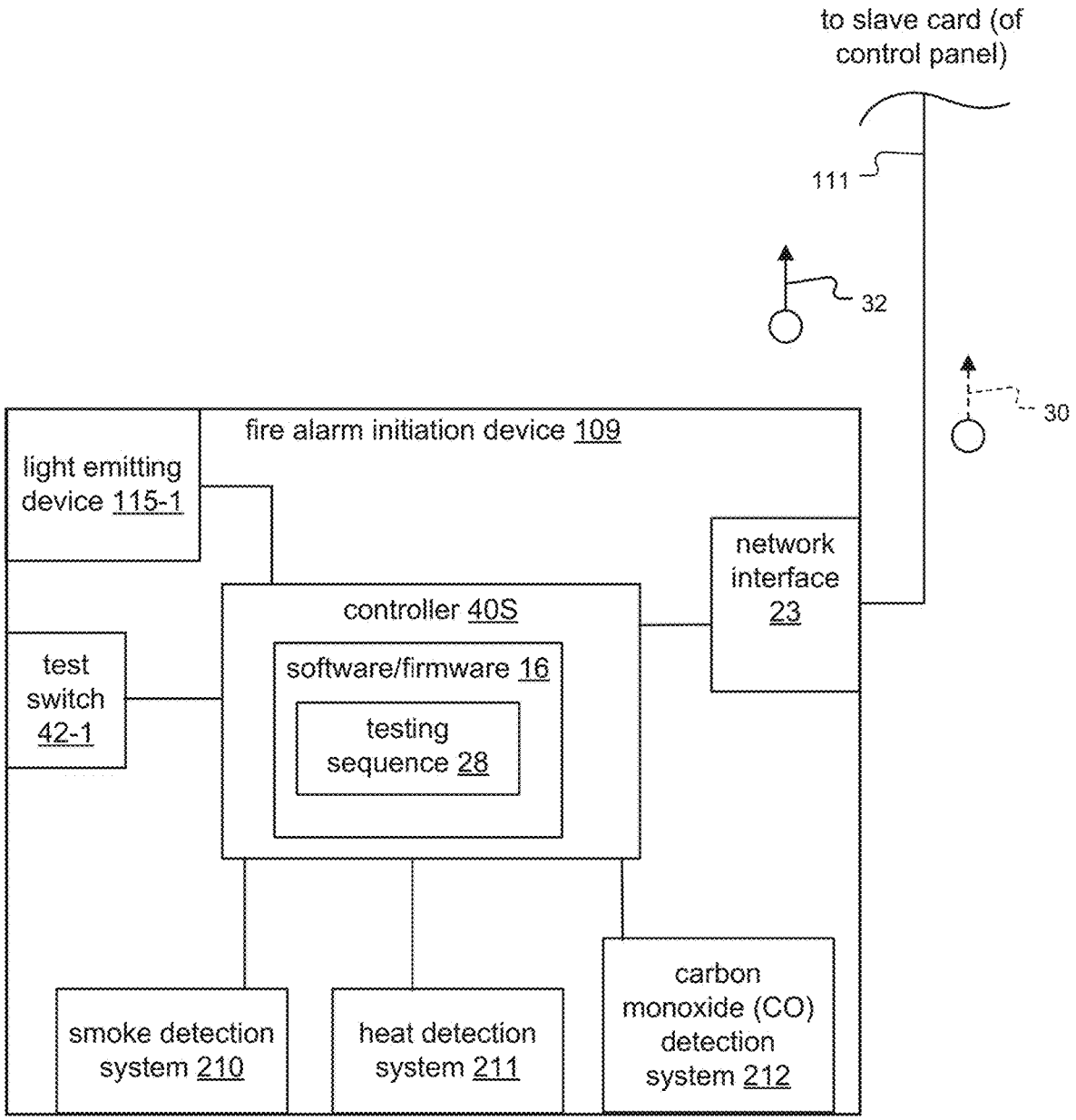
FIG. 2A is a block diagram of an exemplary fire alarm initiating device, according to an embodiment, where the diagram shows various components of the fire alarm initiating device.

FIG. 2A is a block diagram showing more detail for an embodiment of a fire alarm initiation device 109 in FIG. 1.

The fire alarm initiation device 109 has various components. The components include a controller 40S, an indicator such as a light emitting device 115-1, a test switch 42-1 and a network interface 23. In a preferred embodiment, the test switch 42-1 is a magnetic reed switch. In addition, the device 109 includes a fire detection system that detects an indication of fire. In the illustrated example, the device 109 has three different fire sensing modalities. Specifically, the fire detection system of the device 109 includes a smoke detection system 210, a heat detection system 211, and a carbon monoxide (CO) detection system 212.

While some fire alarm initiation devices 109 have two or all three fire sensing modalities, other devices 109 have only one of the fire sensing modalities. In one example, a device 109 that has only a smoke detection system 210 as its fire detection system is also known as a smoke sensor 109-1/109-7. In another example, a device 109 that includes only a heat detection system 211 as its fire detection system is also known as a heat sensor 109-4. The heat detection system 211, in examples, uses heat-sensitive thermocouples and/or thermistors. In yet another example, a device 109 that includes only a CO detection system 212 as its fire detection system is also known as a carbon monoxide detector 109-10. In examples, the CO detection system 212 uses one or more of biomimetic sensors, metal oxide semiconductors, electrochemical sensors, and opto-chemical sensors to detect the CO.

The controller 40S includes software and/or firmware 16 and controls the light emitting device 115-1, the network interface 23 and the fire detection system. The software and/or firmware 16 include a pre-programmed set of instructions for operating the fire alarm initiating device 109 and a testing sequence 28. The set of instructions for operating the device 109 enable the controller 40S (and thus the device 109) to operate in different modes such as a normal mode and a test mode. The testing sequence 28 includes a set of test instructions, the execution of which by the controller 40S carries out testing of the device 109. The controller 40S also prepares messages and signals for transmission to the control panel 102 via the network interface 23.

The light emitting device 115-1 can take multiple forms. In one implementation, the light emitting device 115-1 is a light emitting diode (LED). In another implementation, the device 115-1 is an incandescent light bulb.

The test switch 42-1 controls testing of the fire alarm initiating device 109. The test switch 42-1 is normally deactivated and the device 109 is in a normal mode. In a preferred embodiment, the test switch 42-1 is a magnetic reed switch, which will change state (e.g. open-to-closed or closed-to-open) in response to being exposed to a magnetic field.

Other types of switches beyond magnetically activated switches are possible for the test switch 42-1. In one example, the test switch is an optical switch that is activated in response to receiving light in a predefined wavelength and/or pattern, such as a test pattern. In this way, ambient room lighting or sunlight cannot accidentally activate the test switch 42-1. In yet another example, the test switch 42-1 might also be a mechanical switch such as a momentary push button switch that is activated as long as sufficient force is applied to the switch 42-1, and is deactivated once the force is removed. In yet another example, the test switch 42-1 is an ultrasonic switch.

At startup, the fire alarm initiation device 109 is placed in its normal mode of operation by its controller 40S. When in normal mode, the fire detection system of the device monitors and detects an indication of fire (e.g. smoke, heat, and/or carbon monoxide), and sends an alarm message 32 to the control panel 102 in response to the fire detection system detecting the indication of fire. When the test tool 105 comes within proximity of the device 109, however, the test switch 42-1 is activated. In one example, a magnetic reed switch as the test switch 42-1 is activated when the magnet 52 of the test tool 105 comes within proximity of the magnetic reed switch. The controller 40S senses the activation of the test switch 42-1, and in response, the controller 40S places the device 109 into a test mode.

Upon activation of the test switch 42-1, the fire alarm initiation device 109 enters its test mode, and the controller 40S executes the testing sequence 28 for testing the device 109. The controller 40S sends messages that include test results 30 of the testing sequence 28 to the control panel 102. Activation of the test switch 42-1 also prevents the device 109 from sending an alarm message 32 upon the fire detection system detecting indications of fire during testing.

The indicator (e.g. light emitting device 115-1, speaker) is also energized during testing to indicate that testing of the fire alarm initiation device 109 is in progress. This provides visual or audible indications to the inspector and other building occupants during the testing of the device 109. Once the inspector sees or hears the visual and/or audible indication that the device is in test mode, the inspector triggers the test tool 105 to release and deliver the appropriate indication of fire (e.g. smoke, heat, carbon monoxide) near the device. The term "smoke" includes both actual smoke from a fire, artificial smoke, or smoke equivalent delivered by the test tool 105 during testing.

After the fire alarm initiation device 109 completes testing, the inspector 108 removes the test tool 105 from proximity of the device 109. As a result, the test switch 42-1 is deactivated. The controller 40S detects/senses the deactivation of the test switch 42-1, and introduces a delay before placing the device 109 back in its normal mode, and deenergizes the indicator (e.g. light emitting device 115-1, speaker). The delay, also known as a clearing timer, is required so that the smoke, temperature, or carbon monoxide has had time to return to normal average values. In examples, the delay is as small as one minute, or as large as five minutes. The controller 40S deenergizes the indicator to indicate that testing of the device 109 has completed and that device 109 is again operating in normal mode. Upon completion of the testing, the controller 40S sends a message including the test results 30 over the network 111 to the control panel 102.

Figure 2B:
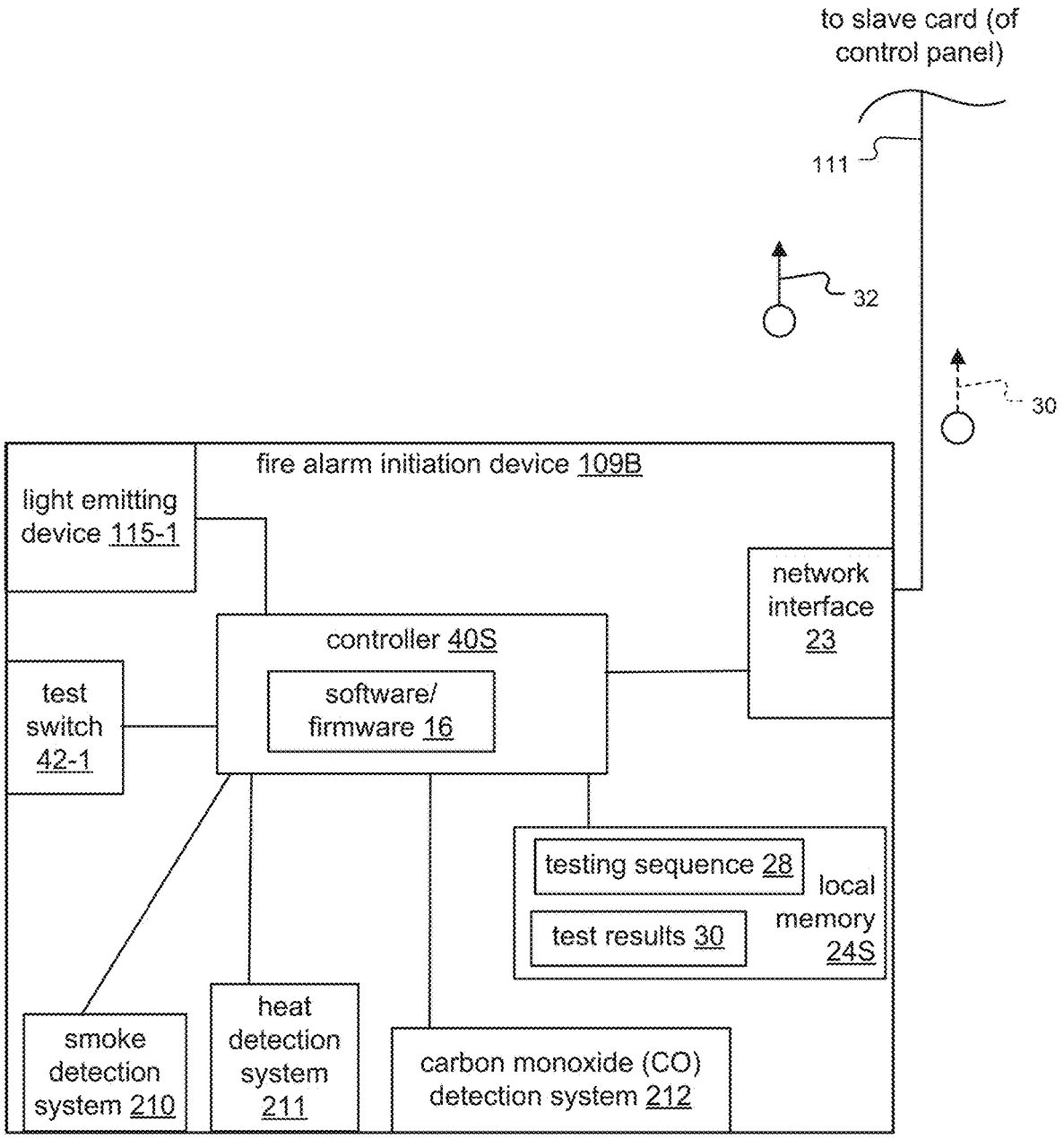
FIG. 2B is a block diagram showing detail for another embodiment of the fire alarm initiation device in FIG. 2A, where the device additionally includes local memory.

FIG. 2B is another embodiment of the fire alarm initiating device in FIG. 2A. The fire alarm initiating device 109B in FIG. 2B includes similar components as and operates in a substantially similar fashion as the fire alarm initiating device 109 in FIG. 2A.

However, the fire alarm initiating device 109B additionally includes local memory 24S, which provides additional functionality beyond that provided in the fire alarm initiating device 109 in FIG. 2A. Examples of the additional functionality are as follows. In one example, rather than the testing sequence 28 being pre-defined within the software/firmware 16 of the controller 40S, the testing sequence 28 is stored to the local memory 24S and can be updated. In another example, the device 109B stores its test results 30 to the local memory 24S in addition to sending its test results 30 in messages to the control panel 102. Inspectors can access the local memory 24S via the network 111 to obtain the test results 30 and to update/replace the testing sequence 28 on the device 109B.

Upon startup of the fire alarm initiating device 109B, the controller 40S loads the testing sequence 28 from the local memory 24S. Otherwise, the device 109B operates in a substantially similar fashion as the smoke sensor 109-1 of FIG. 2A.

As in the fire alarm initiating device 109 of FIG. 2A, the fire alarm initiating device 109B can have one, two, or all three of the fire detection modalities.

Figure 3:
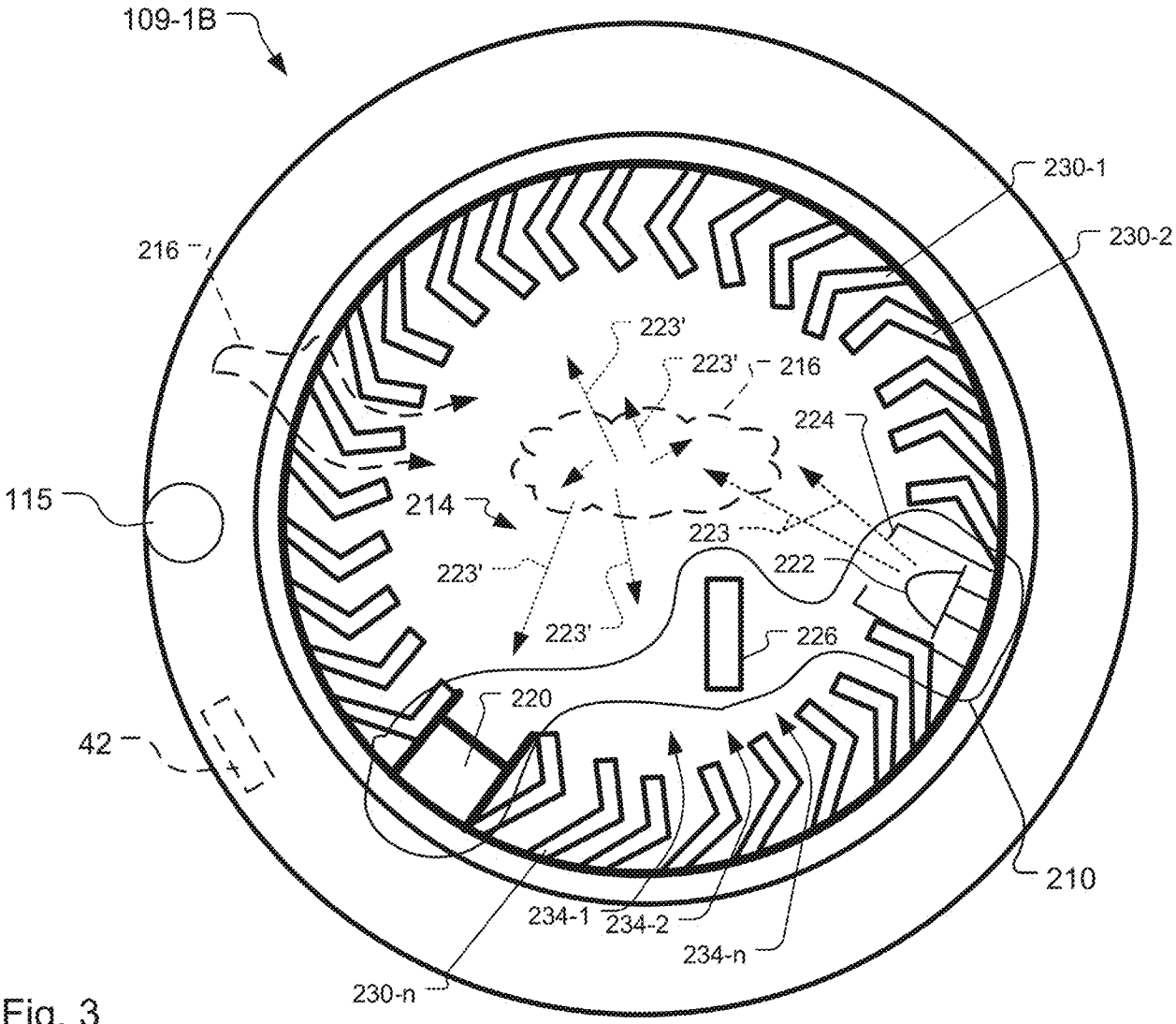
FIG. 3 is a cross-sectional view of a smoke sensor as an example of a fire alarm initiation device, where the device includes the additional local memory shown in FIG. 2B.

FIG. 3 is a cross-sectional view of an exemplary smoke sensor 109-1B constructed in accordance with FIG. 2B. The view illustrates operation of a smoke detection system 210 of the smoke sensor 109-1B, both during testing of the smoke sensor 109-1B and during an actual fire.

The view of the figure illustrates components of the smoke sensor 109-1B including a detection chamber 214 and the smoke detection system 210, according to an embodiment. Components of the smoke sensor 109-1B such as the controller 40S and local memory 24S are mounted to a circuit board within the smoke sensor 109-1B and are hidden from view.

In this embodiment, the detection chamber 214 is defined by individual baffles 230-1 to **230-*n*. The arrangement of the baffles 230-1 to 230-*n* form pathways 234-1 to 234-*n* that allow airflow and possibly environmental smoke 216 to flow into the detection chamber 214**. The baffles are also commonly referred to as channels, vanes, walls, or labyrinths, to list a few examples.

The smoke detection system 210 detects the presence of smoke within the detection chamber 214. In the illustrated example, the smoke detection system 210 includes a chamber light source 222 for generating light 223, a blocking baffle 206, and a scattered light photodetector 220. The scattered light photodetector 220 detects light that has been scattered due to the smoke 216 collecting within the detection chamber 214.

The smoke detection system 210 generally operates as follows. Light 223 from the chamber light source 222 is directed into the detection chamber 214 through an aperture 224. If particulates such as smoke 216 is present in the detection chamber 214, the light 223 is scattered by the smoke 216, resulting in scattered light 223'. The scattered light 223' is then detected by the scattered light photodetector 220. The blocking baffle 226 is installed within the detection chamber 214 to prevent the light 223 from having a direct path to the scattered light photodetector 220. The photodetector 220 then generates a signal having a value that is proportional to the level of scattered light 223' detected by the photodetector 220.

As the number of particulates/incidence of smoke increases within the chamber 214, the amount of scattered light 223' increases, which is detected by the scattered light photodetector 220. Thus, in this way, the signal generated by the photodetector 220 is indicative of the concentration of an optically scattering medium, such as smoke 216, within the detection chamber 214.

The controller 40S receives the signal generated by the photodetector 220 and compares the signal to a threshold level maintained by the controller 40S. The threshold level represents an amount of smoke or other indication of fire that is associated with a fire condition in the building 50. When the signal generated by the photodetector 220 meets or exceeds the threshold level, the controller 40S sends an alarm message 32 to the control panel 102 and possibly activates a local siren of the smoke detector 109-1B.

Figure 4A:
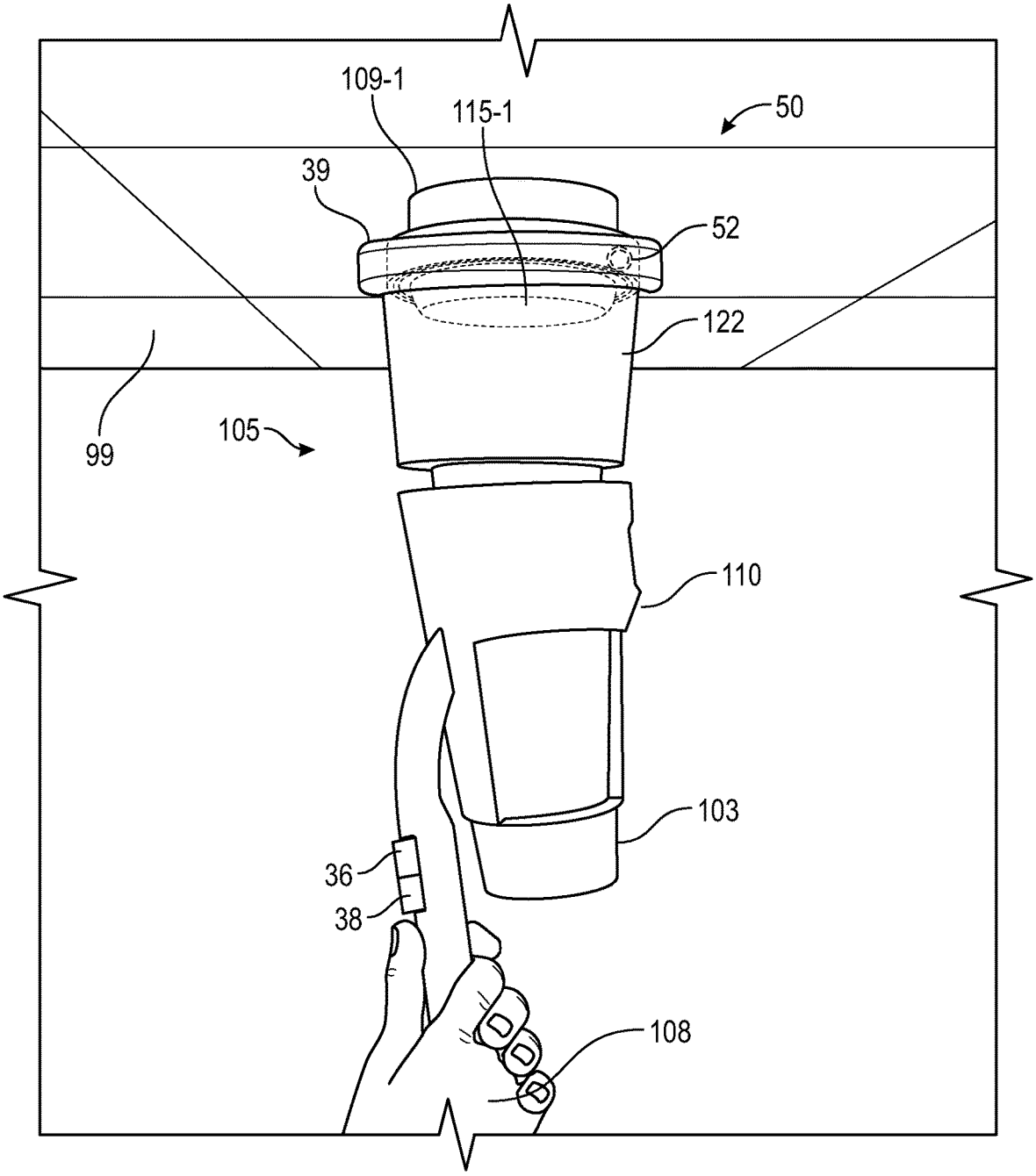
FIG. 4A is an image showing an inspector placing an embodiment of the test tool over an exemplary smoke sensor for testing the smoke sensor, where the smoke sensor is installed in a ceiling within a room of the building.

FIG. 4A is an image showing an inspector 108 placing an embodiment of the test tool 105 over a fire alarm initiating device, such as smoke sensor 109-1 of FIG. 1. The inspector 108 places a hood 122 of the test tool 105 over the smoke sensor 109-1 to initiate testing of the smoke sensor 109-1.

Some components of the test tool 105 are shown. The test tool 105 includes a base 110 and a hood 122 attached to the base 110, and includes a handle or wand 107.

The hood 122 has several components. The hood 122 has a mouth 39 made of a resilient material such as rubber or plastic, in examples. The mouth defines an opening. The hood 122 and the mouth 39 are also made from a substantially transparent material so that an inspector can see the indicator 115-1 being energized during testing.

The base 110 contains a replaceable cartridge or canister 103 such as an aerosol canister for delivering smoke 216, heat, or carbon monoxide during testing of the smoke sensor 109-1.

The wand 107 has a wand activation mechanism (here, buttons 36 and 38) that execute different operations. Button 38 executes operations during testing of the smoke sensor 109-1, such as controlling the generation of smoke 216 from the base 110 into the hood 122. Button 36 executes a self-test of the test tool 105 itself.

The smoke sensor 109-1 is shown installed in a ceiling 99 of a building 50. An inspector 108 is shown placing the opening of the hood 122 such that the mouth 39 encloses the installed smoke sensor 109-1. When the mouth 39 is pressed against a ridge of the sensor 109-1 or against a surface upon which the sensor 109-1 is mounted (e.g. ceiling 99), the mouth 39 forms a tight seal between the smoke sensor 109-1 or ceiling, much like a gasket.

The magnet 52 is mounted to/located within an inside rim of the hood 112, at a specific height below the mouth 39. This height coincides with a corresponding depth of the magnetic reed switch 42-1 of the smoke sensor 109-1, measured from the mounting surface of the smoke sensor 109-1 (here, ceiling 99). In this way, when the mouth 39 of the hood 112 is placed tightly over the smoke sensor 109-1, the magnet 52 will be aligned with and opposite to the magnetic reed switch 42-1 of the smoke sensor 109-1. As a result, the magnetic reed switch 109-1 is activated, and the controller 40S senses the activation.

In the figure, the inspector 108 has placed the mouth 39 of the hood 112 over the smoke sensor 109-1 such that a tight seal is formed between the mouth 39 and the smoke sensor 109-1. In another example, the mouth 39 might also enclose the entirety of the smoke sensor 109-1, and form a tight fit between the surface upon which the smoke sensor 109-1 is mounted (e.g. ceiling 99) and the mouth 39.

Testing of the smoke sensor 109-1 is shown in progress. The indicator (e.g. light emitting device 115-1) is energized during testing, and is visible to the inspector 108 through the transparent hood 122.

Once placement of the hood 112 over the smoke sensor 109-1 occurs as described hereinabove, the inspector 108 selects button 38 for the canister 103 to deliver smoke 216, heat, or CO. The tight seal between the mouth 39 and the smoke sensor 109-1/ceiling area around the smoke sensor 109-1 allows the smoke 216, heat, or CO to flow directly from the hood 122 to the smoke detection system 210 of the smoke sensor 109-1, for testing the smoke detection system 210.

Figure 4B:
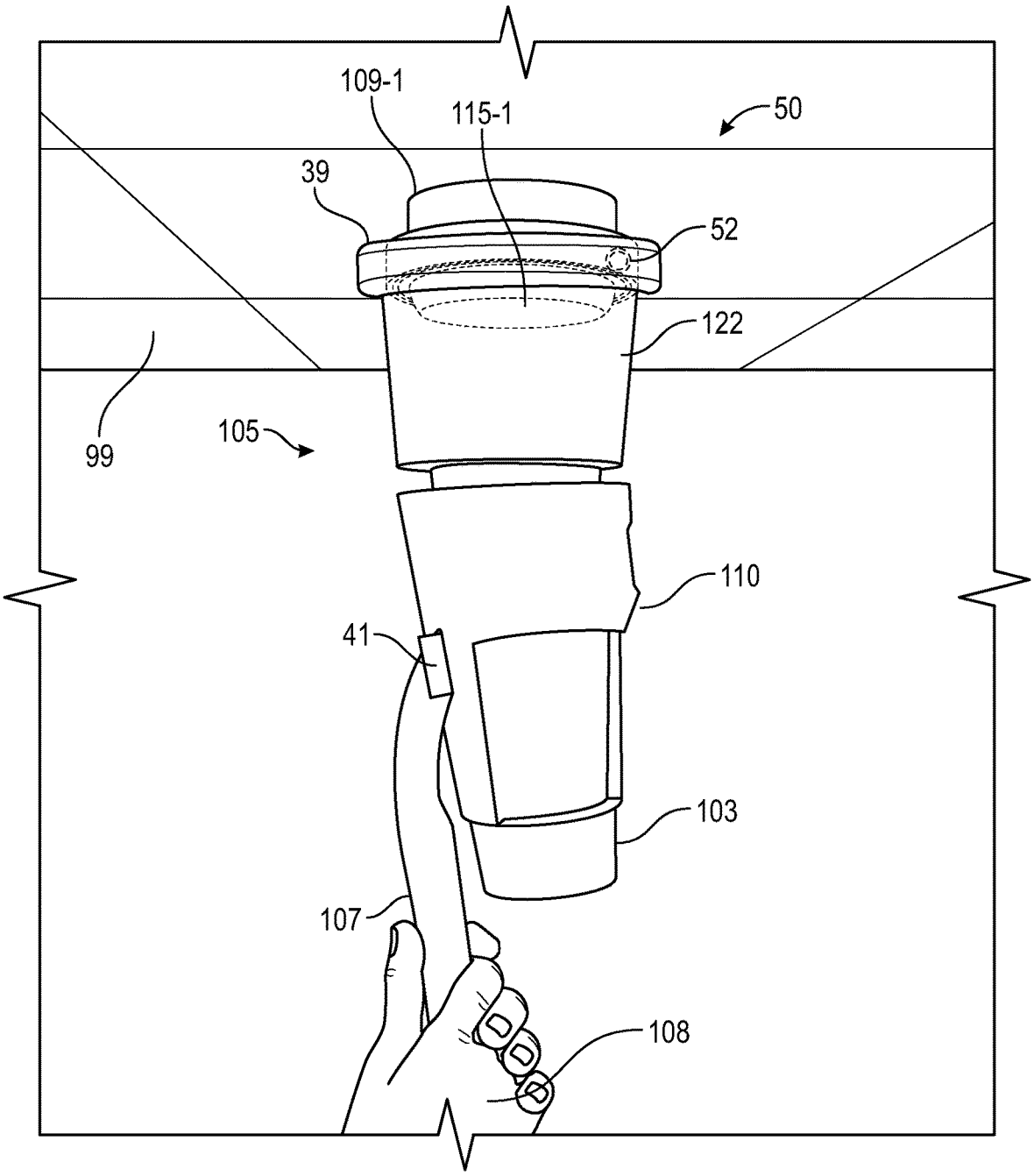
FIG. 4B is an image showing an inspector placing another embodiment of the test tool over an exemplary smoke sensor for testing the smoke sensor.

FIG. 4B is an image showing an inspector 108 placing another embodiment of the test tool 105 over a fire alarm initiating device, such as smoke sensor 109-1 of FIG. 1. As in FIG. 4A, the inspector 108 in FIG. 4B places a hood 122 of the test tool 105 over the smoke sensor 109-1 to initiate testing of the smoke sensor 109-1.

The wand 107 of the test tool 105 in FIG. 4B has a pressure switch 41 as its wand activation mechanism. The pressure switch 41 is activated when the mouth 39 of the hood 112 is placed over the smoke sensor 109-1, and the inspector 108 applies sufficient pressure on the wand 107 in a direction towards the smoke sensor 109-1. In another example, the wand activation mechanism is located near the mouth 39 of the hood 112.

Once the inspector 108 has activated the pressure switch 41, the canister 103 delivers the smoke 216, heat, or carbon monoxide as indicated in the description of FIG. 4A hereinabove.

Figure 5:
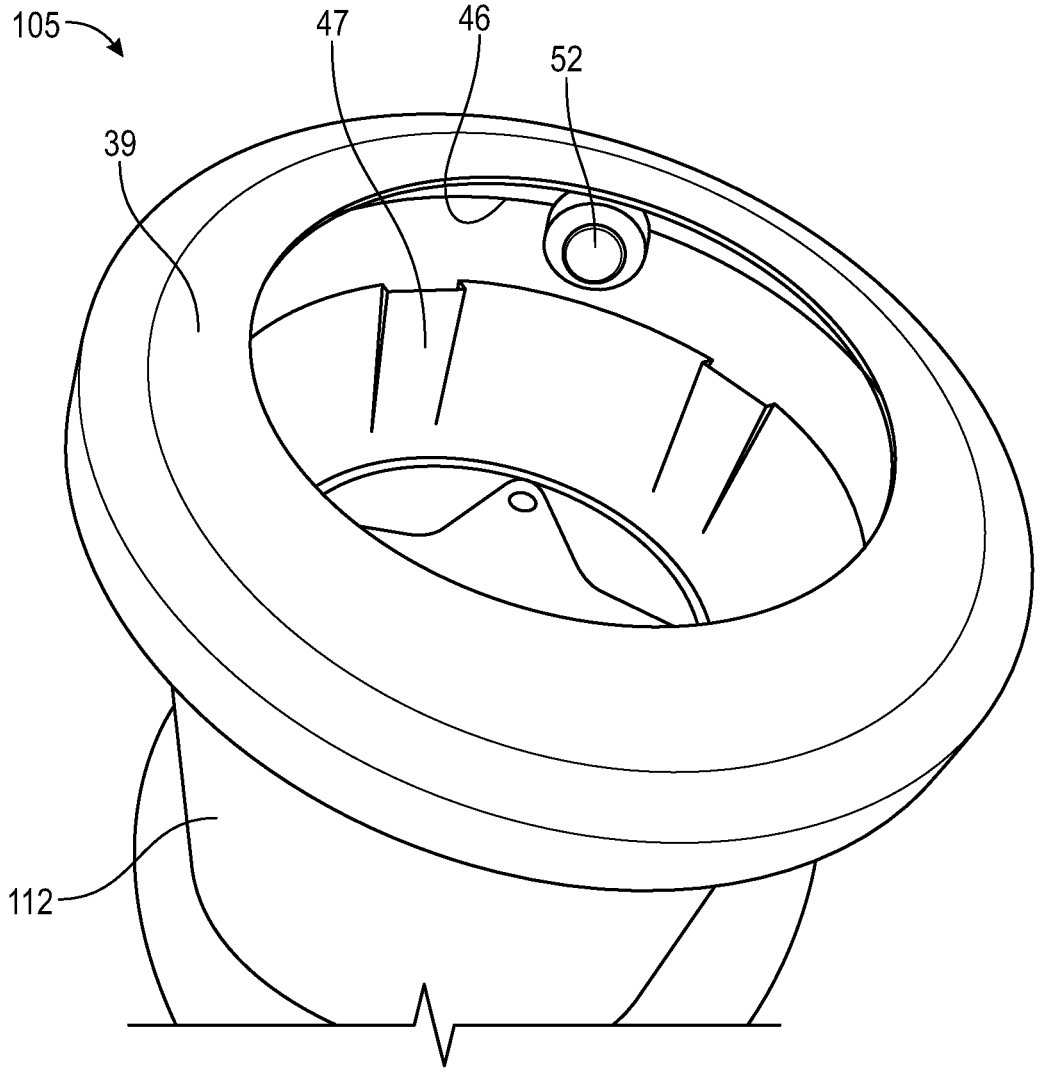
FIG. 5 is an image that shows a magnified perspective view of the test tool, where the image shows detail for a hood of the test tool that is placed over or otherwise encloses installed fire alarm initiating devices during testing of the devices.

FIG. 5 is an image that shows a magnified perspective view of the test tool 105.

The image shows detail for the hood 122 of the test tool 105. The hood 122 is placed over the fire alarm initiation and fire alarm notification devices 109.

A sidewall 47 of the hood 122 and inside rim 46 of the mouth 39 are visible in this figure.

In one implementation, the magnet 52 is attached to the inside rim 46 of the mouth 39. In another implementation, the magnet 52 is mounted in the sidewall 47 of the hood 122.

When the test switch 42-1 is an optically-activated switch or ultrasonically-activated switch, in other examples, a light generating device or an ultrasound generating device respectively replaces the magnet 52.

The test tool 105 and the fire alarm initiating devices such as the smoke sensor 109-1 also form a fire testing system.

Figure 6:
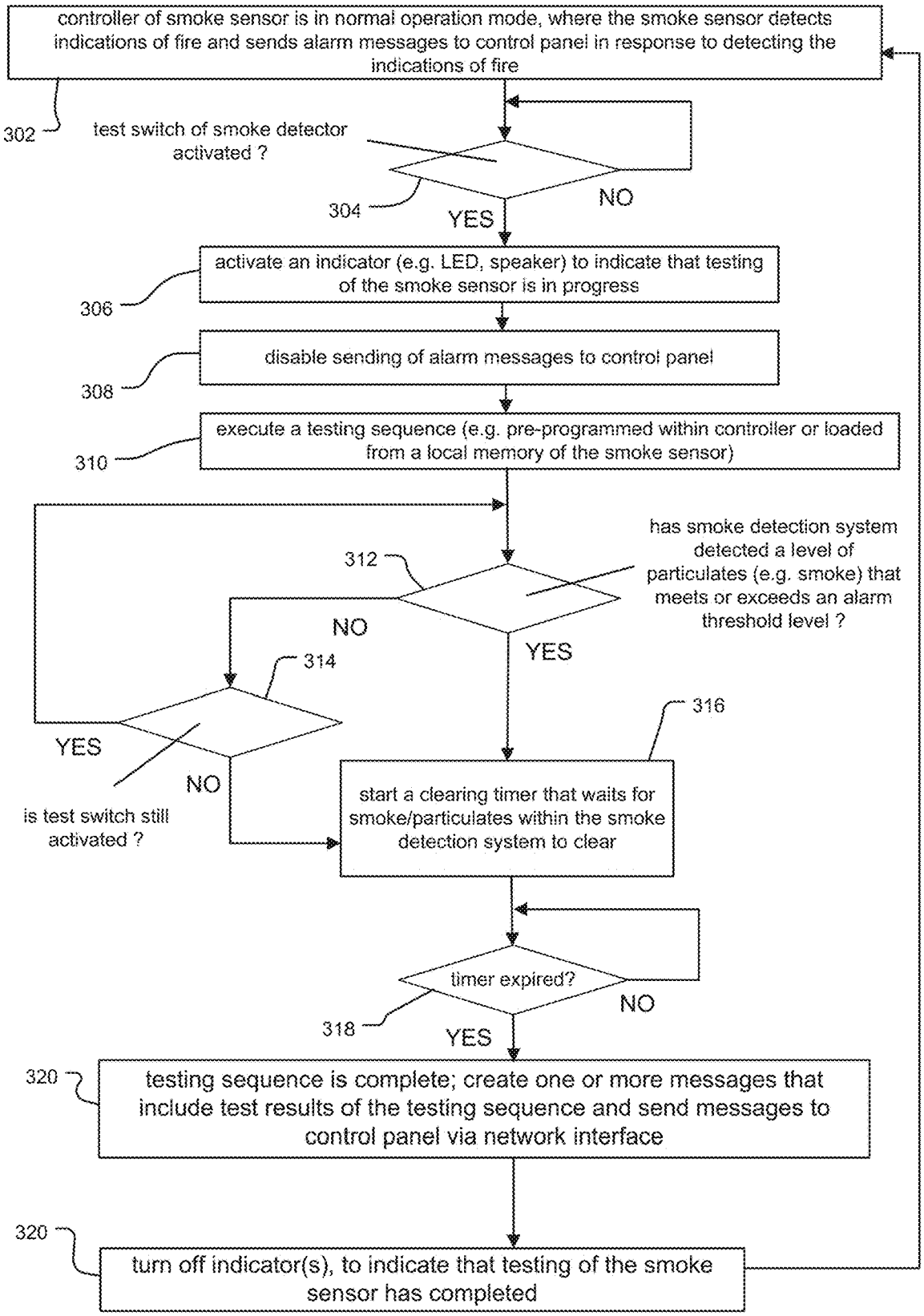
FIG. 6 is a flow chart that illustrates a method of operation of a controller of a smoke sensor, such as the smoke sensors in FIGS. 2A and 2B, where the method describes operation of the controller when the hood of the test tool encloses the device and a magnet within the hood comes within proximity of the smoke sensor to initiate testing of the smoke sensor.

FIG. 6 is a flow chart that illustrates a method performed by a controller 40S of a smoke sensor, such as smoke sensor 109-1 in FIG. 2A and smoke sensor 109-1B in FIG. 3.

In step 302, a smoke sensor 109-1 is in normal operation mode, where the smoke sensor 109-1 detects indications of fire and sends alarm messages 32 to a control panel 102 in response to detecting the indications of fire.

According to step 304, the controller 40S determines whether the test switch 42-1 of the smoke sensor 109-1 has been activated. If the switch has not been activated, the method transitions back to the beginning of step 304. Otherwise, the method transitions to step 306.

In step 306, the controller 40S activates an indicator (e.g. light emitting device 115-1, speaker) to indicate that testing of the smoke sensor 109-1 is in progress. In step 308, the controller 40S also disables sending of alarm messages 32 to the control panel 102.

Then, in step 310, the controller 40S executes a testing sequence 28 to carry out testing of the smoke sensor 109-1. In one example, for the smoke sensor 109-1 of FIG. 2A, the test sequence 28 is pre-programmed within the controller 40S. In another example, for the smoke sensor 109-1B of FIG. 2B, the test sequence 28 is located within and loaded from local memory 24S into the controller 40S.

In step 312, the controller 40S determines whether the smoke detection system 210 has detected a level of particulates (e.g. smoke 216) that meets or exceeds an alarm threshold level. If the threshold has been met or exceeded, the method transitions to step 316. Otherwise, the method transitions to step 314.

In step 314, the controller 40S determines whether the test switch 42-1 is still activated. If the test switch is no longer activated, the method transitions back to the beginning of step 312. Otherwise, the method transitions to step 316.

According to step 316, the controller 40S starts a clearing timer that waits for smoke/particulates within the smoke detection system 210 to clear. The method then transitions to step 318. In step 318, the controller 40S determines whether the clearing timer has expired. If the timer has expired, the method transitions to step 320. Otherwise, the method transitions back to the beginning of step 318.

According to step 320, the testing sequence 28 is complete, and the controller 40S creates one or more messages that include test results 30 of the testing sequence 28. The controller 40S sends the messages to control panel 102 via the network interface 23. In one implementation, the slave cards 98 of the control panel 102 receive the messages including the test results 30 from the device 109-1 (and from other devices 109). In the embodiment of the smoke sensors 109-1B in FIG. 2B, the smoke sensors also save the test results 30 to local memory 24S.

Finally, in step 320, the controller 40S turns off the indicator(s) such as the light emitting device 115-1, to indicate that testing of the smoke sensor 109-1 has completed. The method then transitions back to the beginning of step 302, where the controller 40S places the smoke sensor 109-1 back into its normal mode of operation.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire alarm initiating device, comprising:

a fire detection system for detecting an indication of fire;

a normally deactivated test switch that is activated during testing of the fire alarm initiating device; and a controller of the fire alarm initiating device that senses the activation of the test switch, and in response, prevents the fire alarm initiating device from sending an alarm message to a control panel controller upon the fire detection system detecting the indication of fire, wherein:

the controller of the fire alarm initiating device includes pre-programmed instructions for operating the fire alarm initiating device in a normal mode and in a test mode;

the controller places the fire alarm initiating device into the test mode in response to sensing activation of the test switch;

while in the normal mode, the controller of the fire alarm initiating device sends alarm messages to the control panel controller in response to detecting indications of fire; and while in the test mode, the controller of the fire alarm initiating device disables sending of the alarm messages from the fire alarm initiating device to the control panel controller.

2. The fire alarm initiating device of claim 1, wherein the test switch is a magnetic reed switch that is activated when a hood of a test tool is placed over the fire alarm initiating device, the hood including a magnet that comes within proximity of the magnetic reed switch to activate the magnetic reed switch.

3. The fire alarm initiating device of claim 2, wherein the magnet activates the magnetic reed switch when the magnet is aligned with and opposite to the magnetic reed switch.

4. The fire alarm initiating device of claim 2, wherein the magnetic reed switch is deactivated when the hood is removed from the fire alarm initiating device.

5. The fire alarm initiating device of claim 2, further comprising an indicator that is energized to provide visual or audible indications during the testing of the fire alarm initiating device, and wherein the hood is made from a transparent material that enables the indicator to be seen during the testing of the fire alarm initiating device.

6. The fire alarm initiating device of claim 2, wherein during testing of the fire alarm initiating device, the test tool delivers smoke, carbon monoxide, or heat to the fire alarm initiating device via the hood.

7. The fire alarm initiating device of claim 1, wherein the controller executes a testing sequence for testing of the fire alarm initiating device, and wherein the controller sends messages that include test results of the testing sequence to a control panel.

8. The fire alarm initiating device of claim 7, further comprising a memory, and wherein the testing sequence is located in the memory.

9. A method for a fire alarm initiating device, comprising:

a fire detection system detecting an indication of fire; and activating a normally deactivated test switch of the fire alarm initiating device during testing of the fire alarm initiating device, the activating of the test switch preventing a controller of the fire alarm initiating device from sending an alarm message to a control panel controller in response to the fire detection system detecting the indication of fire.

10. The method of claim 9, wherein the test switch is activated by placing a hood of a test tool over the fire alarm initiating device, the hood including a magnet that activates a magnetic reed switch as the test switch.

11. The method of claim 10, further comprising deactivating the magnetic reed switch by removing the hood from being placed over the fire alarm initiating device.

12. The method of claim 10, further comprising energizing an indicator to provide visual or audible indications during the testing of the fire alarm initiating device, and the hood being made from a transparent material that enables the indicator to be seen during the testing of the fire alarm initiating device.

13. The method of claim 10, further comprising the test tool delivering smoke to the fire alarm initiating device via the hood during testing of the fire alarm initiating device.

14. A fire testing system, the system comprising:

at least one fire alarm initiating device including:

a normally deactivated test switch that is activated during testing of the fire alarm initiating device;

a fire detection system detecting an indication of fire; and a controller of the fire alarm initiating device that senses the activation of the test switch, and in response, prevents the fire alarm initiating device from sending an alarm message to a control panel controller upon the fire detection system detecting the indication of fire; and a test tool including a hood that is placed over the fire alarm initiating device, wherein the hood includes a test switch activation mechanism within the hood that activates the test switch of the fire alarm initiating device when the hood is placed over the fire alarm initiating device.

15. The system of claim 14, wherein the test switch of the fire alarm initiating device is a magnetic reed switch and the test switch activation mechanism is a magnet.

16. The system of claim 15, wherein the magnet is mounted in a sidewall of the hood.

17. The system of claim 14, wherein the test switch activation mechanism activates the test switch of the fire alarm initiating device when the test switch activation mechanism is aligned with and opposite to the test switch.

18. The system of claim 14, wherein the hood is made from a transparent material.

19. A test tool, including:

a base and a hood attached to the base;

a canister contained within the base that delivers smoke, heat or carbon monoxide;

a wand attached to the base for holding the base, the wand including a wand activation mechanism for controlling the test tool; and a test switch activation mechanism within the hood that activates a test switch of a fire alarm initiating device when the hood is placed over the fire alarm initiating device, wherein, upon activation of the test switch, the fire alarm initiating device is prevented from sending an alarm message in response to detecting an indication of fire to a control panel controller.

20. A fire alarm system, comprising:

fire alarm initiating devices that detect indications of fire, each of the fire alarm initiating devices including a normally deactivated test switch that is activated during testing of the fire alarm initiating devices, the activation of the test switch preventing sending of alarm messages from the fire alarm initiating devices to a control panel controller in response to the fire alarm initiating devices detecting the indications of fire during the testing; and a control panel that receives test results from the fire alarm initiating devices upon the fire alarm initiating devices completing testing.

21. The fire alarm system of claim 20, wherein the control panel includes:

one or more slave cards, the slave cards receiving the test results from the fire alarm initiating devices and creating a test report from the test results.

22. The fire alarm system of claim 20, wherein the control panel remains in a normal operation mode during the testing of the fire alarm initiating devices.

23. The fire alarm initiating device of claim 1, wherein the fire alarm initiating device is part of a fire alarm system that includes a control panel comprising the control panel controller, and the control panel communicates with the fire alarm initiating device and other devices of the fire alarm system over a safety and security network of the fire alarm system.

24. The fire alarm initiating device of claim 23, wherein, in response to receiving the alarm messages from controllers of fire alarm initiating devices of the fire alarm system via the safety and security network, the control panel controller raises an alarm condition, sends notification signals to fire alarm notification devices of the fire alarm system to notify and warn building occupants, displays locations of the fire alarm initiating devices that sent the alarm messages on a display of the control panel, and/or notifies a monitoring service.

25. The fire alarm initiating device of claim 24, wherein the fire alarm initiating device is a smoke sensor, heat sensor, carbon monoxide detector, and/or pull station of the fire alarm system.

* * * * *